United States Patent [19]

Dean et al.

[11] 4,139,428

[45] Feb. 13, 1979

[54] PREPARATION OF ALKALI METALS

[75] Inventors: Albert J. Dean; Francis J. Ross, both of Niagara Falls, N.Y.

[73] Assignee: E. I. Du Pont de Nemours and Company, Wilmington, Del.

[21] Appl. No.: 847,033

[22] Filed: Oct. 31, 1977

[51] Int. Cl.[2] ..... C25C 3/02
[52] U.S. Cl. ..... 204/68
[58] Field of Search ..... 204/68

[56] References Cited

U.S. PATENT DOCUMENTS 1,826,773 10/1931 Grebe et al. ..... 204/68

*Primary Examiner*—Howard S. Williams

[57] ABSTRACT

The electrolytic production of an alkali metal, such as sodium, from a conventional Downs cell can be reduced by the addition to the fused alkali metal salt electrolyte of small amounts of anhydrous aluminum oxide or magnesium oxide, preferably aluminum oxide. Production can be recovered by the removal of either the aluminum or magnesium metal values from the cell.

4 Claims, No Drawings

PREPARATION OF ALKALI METALS

BACKGROUND OF THE INVENTION

1. Field of Invention

This invention relates to processes for the production of alkali metals, especially sodium, and more particularly to electrolytic processes for such production wherein production can be reduced without shutting down the process.

2. Prior Art

Metallic alkali metals are produced generally by the electrolysis of molten halogen salts of such metals, especially mixtures of such salts with other salts which are substantially inert. For example, sodium metal can be produced by electrolysis of a molten binary mixture of calcium chloride and sodium chloride or a ternary mixture of calcium chloride, sodium chloride and barium chloride.

Lithium metal is usually produced by electrolysis of a molten binary eutectic mixture of potassium chloride and lithium chloride.

The type of electrolytic cell most widely used for the above-described operations is the "Downs" cell, which is described in U.S. Pat. No. 1,501,756 to J. C. Downs. Of course, many improvements have been made to this cell over the years; but, basically the Downs-type electrolytic cell is comprised of a refractory lined steel shell for holding the molten salt electrolyte, a submerged cylindrical graphite anode surrounded by a cylindrical steel cathode. A woven wire diaphragm is positioned in the annular space between the electrodes to separate the anode and cathode products, namely halogen gas and the alkali metal. To collect product halogen gas from the anode, the cell is provided with collector means such as an inverted cone which fits over the anode below the surface of the molten electrolyte. Halogen gas (usually chlorine) passes upwardly through the cone and, via appropriate manifold components, from the cell. Similarly, the cathode is also provided with collector means such as an inverted inclined trough which fits over the cathode below the surface of the molten electrolyte. Molten alkali metal rises from the cathode toward the surface of the molten electrolyte, is collected along the inclined surface of the trough and is passed to a vertical riser/cooler pipe in which the molten metal is partially cooled before it is passed to a product receiver.

Commercial Downs cells frequently contain a plurality of electrode assemblies, in which case the anode product collectors are manifolded together to provide a single gas outlet from the cell. Usually, a common cathode product collector is provided which surrounds all of the gas collector cones. That is, the means for collecting the halogen gas is positioned within the perimeter of the molten alkali metal collector. Detailed illustrations and descriptions of such cells can be found in the following U.S. Patents:

| | | |
|---|---|---|
| R. E. Hulse | U.S. 2,130,801 | Sept. 20, 1938 |
| J. S. Honea | 2,770,364 | Nov. 13, 1956 |
| A. L. Fentress | 2,770,592 | Nov. 13, 1956 |
| G. O. Hoyes | 2,944,950 | July 12, 1970 |
| C. T. Gallinger | 3,037,927 | June 5, 1962 |
| G. T. Motock | 3,085,967 | April 16, 1963 |
| S. E. Eckert and F. J. Ross | 3,118,827 | Jan. 21, 1964 |

-continued

| | | |
|---|---|---|
| J. M. Wood | 3,248,311 | April 26, 1966 |
| L. L. Harris | 3,463,721 | Aug. 26, 1969 |

To reduce alkali metal production from Downs cells, whenever the need arises, for example, a raw material shortage, a strike or over-production, one heretofore could only reduce production either by a limited amount (about 5%) through a tolerable cell amperage reduction or by total cell shutdown. If the current flow is reduced so that production is less than about 95% of its normal value, there is not enough electrical resistance heating of the electrolyte to keep it in the molten state. If the cells are shut down, the electrolyte freezes and the cell must be rebuilt. In the latter case, for instance, a 40% reduction in production means a total shutdown of about 40% of the total operating cells. Total cell shutdown results in a severe financial penalty due to the expense in rebuilding the cells plus the long-term production loss due to the extended period of time required to rebuild the cells. Thus, it has been desirable for quite some time to be able to reduce alkali metal production for a short period of time without affecting product quality, shutting down cells or encountering problems such as polarization, foaming and uncontrollable temperature excursions that result from electrolyte contamination with impurities such as sulfates, boron and soda ash.

SUMMARY OF THE INVENTION

According to the present invention there is provided a process for the production of an alkali metal by electrolyzing a fused alkali metal salt electrolyte comprising: electrolyzing said electrolyte with direct current, said electrolyte additionally containing about 0.01 percent to about 2 percent by weight of anhydrous aluminum oxide or magnesium oxide.

There is also provided a method of reducing the production of alkali metal in the process of electrolyzing a fused alkali metal salt electrolyte within a direct current electrolytic cell which comprises: adding to the electrolyte about 0.01 to about 2 percent by weight of the electrolyte of anhydrous aluminum oxide or magnesium oxide and recovering the production of the cell by removing aluminum or magnesium metal values from the cell.

DETAILED DESCRIPTION OF THE INVENTION

It has now been discovered that the addition of a small amount of anhydrous aluminum oxide or magnesium oxide, preferably the aluminum oxide, to the fused alkali metal salt electrolyte contained in a conventional Downs-type electrolytic cell reduces the production rate of the cell without permanent damage to it and without adversely affecting product quality. The production rate can be recovered by removal of aluminum or magnesium from the cell, which has resulted from the electrolytic reduction of the oxide, whenever it is desired to increase production. Since the aluminum or magnesium short-circuits the cell by plating out between the cell diaphragm and cathode, its removal and the recovery of the alkali metal production rate are generally realized by getting rid of this plated out metal by breaking it loose by shaking the diaphragm so it falls to the bottom of the electrolyte and/or by physically removing it from the cell by changing the cell diaphragm.

The electrolytic production of alkali metals, especially sodium and lithium, in a Downs-type, direct current electrolytic cell is well known in the art. Detailed descriptions of such a cell can be found in any of the patents mentioned in the Prior Art section.

The fused alkali metal salt electrolyte used in the Downs cell can be any of those described and known in the art. While many salt mixtures have been described in the art as being useful for the electrolyte in the production of sodium, there are two of major interest. The first is a binary mixture of sodium chloride and calcium chloride which consists essentially of about 56–60 percent by weight calcium chloride with the remainder being sodium chloride and a very small amount of barium chloride which may be present as an impurity in the sodium chloride. The second is described in U.S. Pat. No. 3,020,221, issued Feb. 6, 1962 to William H. Loftus. As described therein, this electrolyte is a ternary mixture of sodium chloride, calcium chloride and barium chloride which consists essentially of about 15–30 percent by weight calcium chloride, a sodium chloride content having a lower limit of 20 percent, an upper limit of 30 percent when the calcium chloride content is less than 24 percent and an upper limit of 35 percent when the calcium chloride is 24 percent or higher, with the remainder being barium chloride. These and other electrolytes usually have a melting point below about 600° C.

Other fused alkali metal salt electrolytes are described in U.S. Pat. No. 464,097, issued to Grabau on Dec. 1, 1891 (a ternary mixture of sodium chloride, another alkali metal halide and an alkaline earth halide); U.S. Pat. No. 841,724, issued to Seward et al. on Jan. 22, 1907 (a salt mixture of sodium chloride, sodium fluoride and an alkali earth chloride); U.S. Pat. No. 2,850,442, issued to Cathcart et al. on Sept. 2, 1958 (a salt mixture of sodium chloride, barium chloride and strontium chloride); U.S. Pat. No. 2,876,181, issued to Wood on Mar. 3, 1959 (a binary salt mixture of sodium chloride and lithium chloride); and U.S. Pat. No. 3,712,858 issued to Ross on Jan. 23, 1973 (a quaternary salt mixture of sodium chloride, barium chloride, calcium chloride and potassium chloride). Other cell electrolyte compositions are described in U.S. Pat. No. 3,119,756; British Pat. Nos. 15,649, and 16,060; Canadian Pat. No. 670,314; U.S. Pat. No. 3,072,544; U.S. Pat. No. 3,051,635 and U.S. Pat. No. 3,257,297.

A lithium Downs cell electrolyte is conventionally a binary mixture of lithium chloride and potassium chloride.

Anhydrous aluminum oxide or magnesium oxide is added to the fused alkali metal salt electrolyte at a concentration of about 0.01 to about 2 percent by weight of the electrolyte, preferably about 0.1 to about 0.5 percent. While greater amounts of the oxide can be added, there is no economic incentive in doing so. As would be expected, the more oxide added to a cell, the greater the cut-back in production. Of course, along with this greater cut-back goes a greater period for cell recovery. An upper limit on oxide addition will be that amount which will completely shut-down the cell.

As is well known in this art, the presence of water is detrimental to the electrolytic process since it reacts with molten sodium to make hydrogen which can form explosive mixtures with air and it gives excessive wear of the anode. Thus, the oxide used should be anhydrous. This means that there is no water of crystallization present in the oxide used, although there may be a very small amount present hygroscopically. For best results, the oxide should be as dry as possible.

The electrolyte should be at a temperature below the melting point of the aluminum or magnesium formed so that short circuits are formed in the cell. Since both aluminum and magnesium melt at about 660° C. and Downs cells are conventionally operated at under about 620° C., temperature is not a critical variable.

As mentioned previously, the production rate of the cell is recovered by removing electrolyzed aluminum or magnesium from the cell. The removal is usually intermittent due to the fact that it takes time for the aluminum or magnesium to plate-out on the cell diaphragm and the fact that diaphragm shaking and changing are labor intensive. While individual cell recovery can proceed as desired, the recovery of a whole plant containing hundreds of cells will, of course, take more time. Thus, when a reduction in alkali metal production is desired, one alternative is to operate some cells at full capacity and treat the remaining cells according to the invention to obtain the desired reduction. As would be expected, recovery of production can be faster when fewer cells are treated.

The process of the invention enables an alkali metal manufacturer to obtain a controlled reduction in production and a controlled recovery in that production. This is advantageous in that it is an alternative to total cell shut-down when the economics of the reasons for production reduction are studied. For a long term reduction in production, it may still be more economical to shut-down a portion of the total number of cells.

The invention can be further understood by reference to the following examples in which parts and percentages are by weight.

EXAMPLE 1

The salt feed to an entire sodium plant was accidentally contaminated with granular anhydrous aluminum oxide ($Al_2O_3$). This resulted in each conventional, operating Downs cell in the plant containing an estimated 0.5 percent $Al_2O_3$ in the electrolyte which was a molten ternary mixture of about 29 percent sodium chloride, about 24 percent calcium chloride and the remainder barium chloride. All of the cells in the plant were operating, before contamination, at an average of 88% current efficiency, an electrolyte temperature of about 610° C., at about 41,000 amperes and a voltage potential of 7.2–7.4.

By the next day, the average cell current efficiency dropped to about 25% due to short circuiting of the cell diaphragms and cathodes with electrolyzed aluminum. This was a drop of 63 percent current efficiency or about a 72 percent reduction in sodium production. It was noted that sodium and chlorine product quality remained unaffected by the electrolyte contamination.

A cell recovery program was started immediately. This program was one of changing the diaphragms of the cells every 20–25 days with diaphragm shaking between changes. Shaking was carried out about twice a day initially and then every second day as the recovery progressed. When cell diaphragms were changed, aluminum was removed from the cell not only as aluminum dendritic deposits on the diaphragms but also as aluminum scraped from the cathode walls and some skimmed from the surface of the molten electrolyte. It was found that the excess of the partially soluble aluminum oxide sank to the bottom of the cell and gradually dissolved in the electrolyte as the aluminum metal (some as a calcium alloy) was removed from the cells.

During recovery, the average cell current efficiency progressed as follows:

After 1 week—50% Current efficiency

After 2 weeks—77% Current efficiency

After 3 weeks—84% Current efficiency

After 4 weeks—87% Current efficiency

All of the cells during the recovery period showed an unexpected predictability in their response to shaking and changing of the diaphragms. There was no permanent damage to the cells and product quality remained high during the entire period.

EXAMPLE 2

Four commercial sodium Downs cells that were scheduled for pumpout and the normal rebuilding program were used to test the effect of the addition of a smaller quantity of anhydrous aluminum oxide to the cell electrolytes which were the same as in Example 1. The electrolysis conditions were also the same as in Example 1. These four cells had been in operation for an average of 978 days and had an average current efficiency before the test of about 73.2%.

To each cell electrolyte was added about 0.1 percent anhydrous aluminum oxide, based on the total weight of electrolyte. Cells 1 and 2 had the aluminum oxide added all at once and the other two cells received one-half of the aluminum oxide on the first day of the test and the remainder the next day.

After the cells operated for one week, the average current efficiency for the cells was 43.6%, an average drop of 29.6% or a sodium production reduction of about 40 percent. Sodium and chlorine product quality were the same as before the test started. The test was concluded by shutting down the cells for their scheduled rebuilding. The detailed results for each cell are shown in Table I.

TABLE I

| | Cell Number | | | | Cell |
|---|---|---|---|---|---|
| | 1 | 2 | 3 | 4 | Avg. |
| Cell age (days) | 803 | 1023 | 1082 | 1002 | 978 |
| Current Efficiency (%) | | | | | |
| Before Test | 70.6 | 79.5 | 69.5 | 73.3 | 73.2 |
| After 7 days | 32.0 | 50.7 | 43.0 | 48.8 | 43.6 |
| Current Efficiency Drop (%) | 38.6 | 28.8 | 26.5 | 24.5 | 29.6 |
| Fraction of Former Prod. | 0.45 | 0.64 | 0.62 | 0.67 | 0.60 |

The above test showed that the addition of small amounts of anhydrous aluminum oxide to the cell electrolyte can reduce the production of sodium without a costly shutdown of the cell. This was shown to be done without affecting the sodium and chlorine product quality.

What is claimed is:

1. In a process for the production of an alkali metal by electrolyzing a fused alkali metal salt electrolyte within a direct current electrolytic cell, a method of reducing the production of the alkali metal from said cell comprising: adding to the electrolyte about 0.01–2 percent by weight of the electrolyte of anhydrous aluminum oxide or magnesium oxide and recovering the production of the cell by removing aluminum or magnesium metal values from the cell.

2. The process of claim 1 wherein anhydrous aluminum oxide is added to the cell at a concentration of about 0.1 to about 0.5 percent by weight.

3. The process of claim 2 for the production of sodium wherein the electrolyte has a melting point below about 600° C. and is a binary mixture of sodium chloride and calcium chloride or a ternary mixture of sodium chloride, calcium chloride and barium chloride.

4. The process of claim 3 wherein the removal of aluminum metal values is intermittent.

* * * * *